US007217062B2

(12) United States Patent
Pisano et al.

(10) Patent No.: US 7,217,062 B2
(45) Date of Patent: May 15, 2007

(54) CONTROL FOR SCREED HEATERS

(75) Inventors: Francesco Pisano, Bologna (IT); Federico B. Rio, Bologna (IT); Davide Govoni, Ferrara (IT); Ezio Martelli, Bologna (IT); Simone Zaghi, Mezzogoro (IT)

(73) Assignee: Caterpillar Paving Products Inc, Minneapolis, MN (US)

( * ) Notice: Subject to any disclaimer, the term of this patent is extended or adjusted under 35 U.S.C. 154(b) by 260 days.

(21) Appl. No.: 11/063,259

(22) Filed: Feb. 22, 2005

(65) Prior Publication Data

US 2005/0191127 A1 Sep. 1, 2005

(30) Foreign Application Priority Data

Feb. 23, 2004 (EP) ..... 04004082

(51) Int. Cl.
*E01C 23/14* (2006.01)

(52) U.S. Cl. ..... 404/77; 404/79; 404/95; 700/299; 700/300

(58) Field of Classification Search ..... 404/77, 404/79, 84.05, 84.1, 95; 700/299, 300
See application file for complete search history.

(56) References Cited

U.S. PATENT DOCUMENTS 3,673,930 A 7/1972 Birtchet
4,781,491 A * 11/1988 Chiba et al. ..... 404/95
5,417,516 A * 5/1995 Birtchet ..... 404/71
5,521,850 A * 5/1996 Moe et al. ..... 700/299
5,607,254 A * 3/1997 Grembowicz et al. ..... 404/79
5,895,172 A * 4/1999 Grembowicz et al. ..... 404/79
6,334,735 B1 * 1/2002 Williams et al. ..... 404/79
6,421,594 B1 * 7/2002 Erasmus ..... 701/50

FOREIGN PATENT DOCUMENTS

EP 1295990 A2 3/2003
WO WO 00/47822 8/2000

* cited by examiner

*Primary Examiner*—Gary S. Hartmann
(74) *Attorney, Agent, or Firm*—Finnegan, Henderson, Farabow, Garrett & Dunner

(57) ABSTRACT

A screed for a paving machine has at least a base portion having an associated heating element connected to a heating element controller. An extension screed portion is connector to the base screed portion and has a respective heating element connectable to the heating element controller. A temperature sensor is associated with each of the base and extension screed portions and a device is adapted to controllably connect selected ones of the base and extension screed temperature sensors to the heating element controller.

11 Claims, 3 Drawing Sheets

CONTROL FOR SCREED HEATERS

This application claims priority to European Application No. 04004082.6, filed Feb. 23, 2004.

TECHNICAL FIELD

The present invention relates to paving machines having screed assemblies and, more particularly, to paving screed assemblies having screed heaters.

BACKGROUND

Paving machines are used for depositing, spreading, compacting, and smoothing paving material on a roadbed in such a manner that a uniform and drivable surface is produced. In the case of an asphalt paving machine, the paving material is typically an aggregate filled bituminous mixture that is deposited on a roadbed while hot. Once the mixture cools after being suitably compacted and smoothed, a hardened pavement surface results.

Paving machines use screed assemblies to smooth and compact the paving material. The screed assembly is typically drawn behind the paving machine and is adjustable to establish the thickness of the deposited layer of paving material.

A screed assembly typically includes a base portion and may include one or more extension portions, each of these portions having steel screed plates mounted to the screed portions in such a manner that the plates both smooth and compress the deposited paving material, leaving behind a mat of the desired thickness. The screed plates are typically heated to prevent the bituminous material from clinging to the steel plates. In modem screed assemblies, the screed plate heaters are commonly implemented in the form of resistive electrical heaters that can be optimally positioned on or near the screed plates. Screed plates may also be heated by gas or other combustible fuel heaters.

It is important to maintain a proper screed plate temperature. If the screed plates are either too hot or too cold, a poor finish will be obtained in the resulting pavement mat. In a simple screed having only base screed portions, each of the base screed portions typically includes both a heater and a temperature sensor. In such a system, each of the base screed plates may be individually temperature controlled according to feedback received from the associated temperature sensor.

However, many screed assemblies make provision for attaching extension screeds to the ends of the base screed portions. These extension screed portions must be mechanically connected to the base screed portions, and must also be connected to provide controlled power to the heating elements. It is known to merely connect the heating elements of the extension screed portions in parallel with the heating elements of the base screed. In such a configuration, the extension screed heaters are controlled in response to temperature sensors located on the base screed portion. Consequently, the extension screed portions may be either too hot or too cold to produce a desired mat finish.

The present invention is directed to overcoming one or more of the problem set forth above.

SUMMARY OF THE INVENTION

In one aspect of the present invention, a screed for a paving machine has at least one base screed portion having an associated heating element connected to a heating element controller. The screed also has at least one extension screed portion connectable to the base screed portion, and having a respective heating element connectable to the heating element controller. A temperature sensor is associated with each of the base and extension screed portions, and a switching device is adapted to controllably connect selected ones of the base and extension screed temperature sensors to the heating element controller.

In a second aspect of the present invention, a system for controlling the temperature of the screed plates of a paving machine screed includes a heating element controller, and has at least one base screed portion and at least one extension screed portion connectable to the base screed portion. Each of the base and extension screed portions has a respective heating element connectable to the heating element controller and has a respective temperature sensor positioned to be responsive to the temperature of a respective screed plate. The system includes means for connecting the at least one extension screed portion to the temperature controller and means for controlling the temperature of the base and extension screed plates in response to the connecting means.

In a third aspect of the present invention, a method is disclosed for selectively controlling the heating elements associated with a screed for a paving machine. The screed includes at least one base screed portion having a heating element connected to a heating element controller and one or more extension screed portions connectable to the base screed portion. Each of the extension screed portions has a respective heating element connectable to the heating element controller, a temperature sensor associated with each of the base and extension screed portions, and a switching device adapted to controllably connect selected ones of the temperature sensors to the heating element controller. The switching device includes a number of electrical connectors corresponding at least to the maximum desired number of connectable extension screed portions. The method includes the steps of connecting a desired number of the extension screed portions to selected respective ones of the switching device electrical connectors, and connecting a predetermined one of the temperature sensors to the heating element controller in response to the selected mating of the extension screed portions to the electrical connectors.

DETAILED DESCRIPTION

Figure 1:
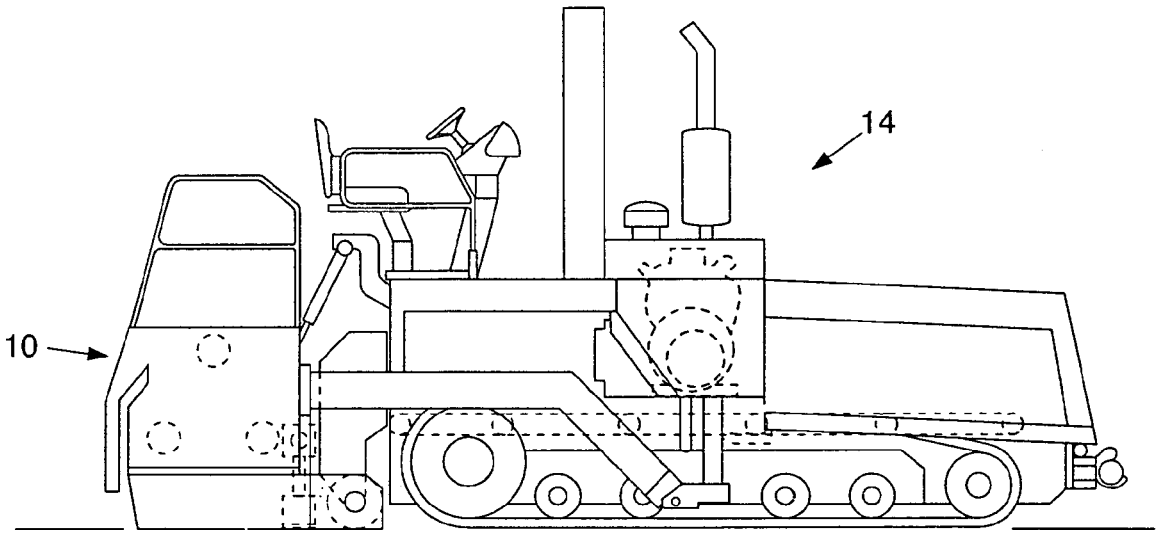
FIG. 1 is a diagrammatic side view of a paving machine including a screed assembly.
Figure 2:
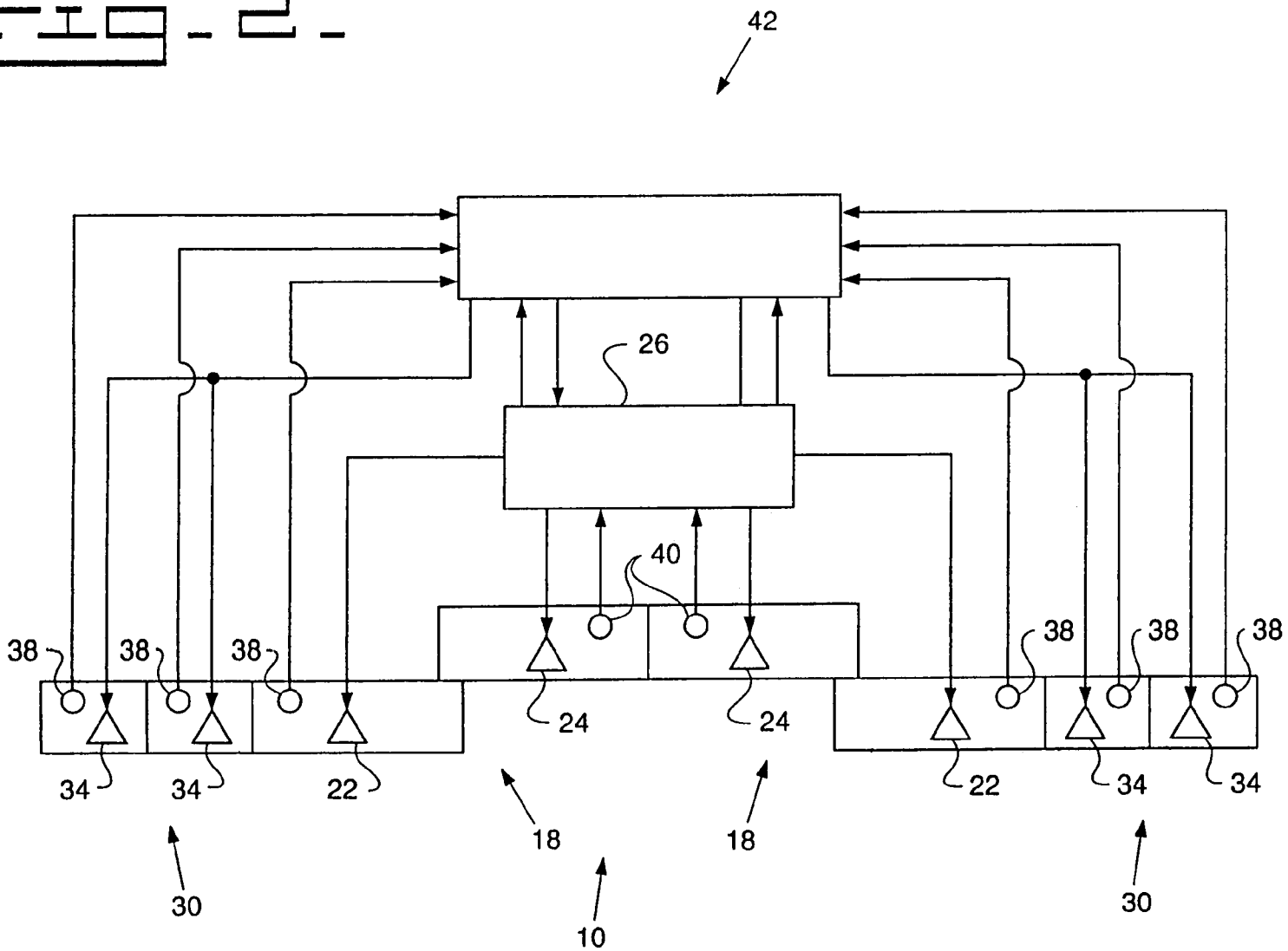
FIG. 2 is a schematic view of a portion of the screed assembly of FIG. 1.
Figure 3:
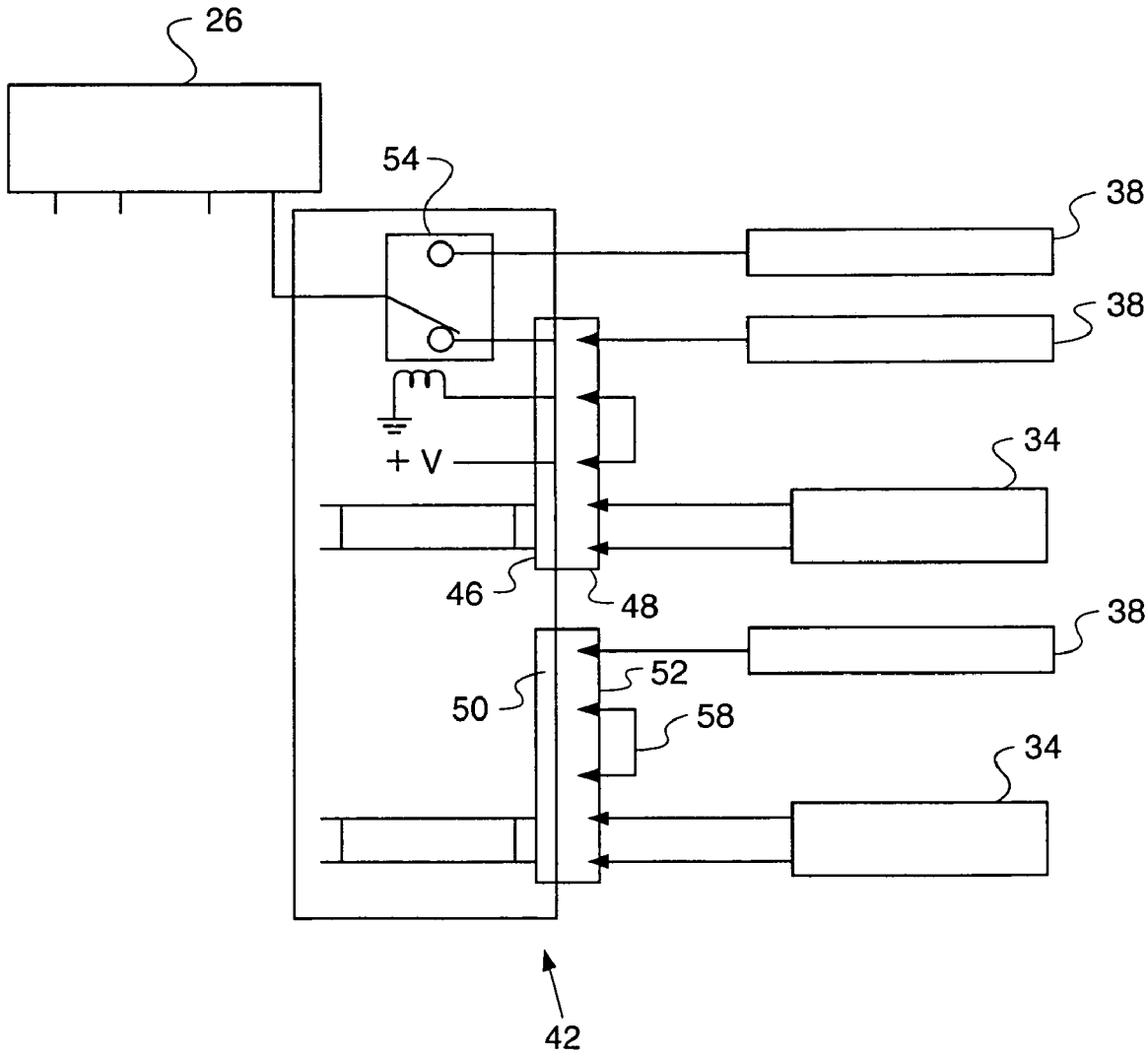
FIG. 3 is a block diagram view of a portion of the screed assembly of FIG. 1.

A screed 10, as depicted in the figures, is constructed as might typically be found in a commercial screed product. Screeds 10 typically include left-hand and right-hand base screed portions 18 (with reference to the screed 10 centerline) that may be independently controllable to produce a pavement surface having a desired configuration, for example, a road surface having a crowned center portion. Base screed portions 18 are often segmented, as is most clearly seen in FIG. 2, to provide for ready transport between job sites. In such configurations, the base screed portions 18 often include two or more sections that may be collapsed or moved inwardly toward the center of the paving machine 14 to reduce the overall screed width, and that may be moved outwardly to increase the width. In addition, one or more extension screed portions 30 may be readily attached to the outermost ends of the base screed portions 18 to provide still greater paving width capabilities. For simplicity in description, the following technical discussion generally focuses on one half, either right-hand or left-hand, of a screed assembly. However, it should be understood that the description and appended claims apply equally to the second half of such a screed assembly. Also, throughout this description, references to the base screed portions 18 are to the outermost end or extended portions of a segmented base screed, as discussed above.

Referring generally to the Figures, a screed 10 for a paving machine 14 is shown. The screed 10 has at least one base screed portion 18 having an associated heating element 22 connected to a heating element controller 26. The screed 10 may also have at least one extension screed portion 30 connectable to the base screed portion 18 and having a respective heating element 34 connectable to the heating element controller 26 through a switching device 42. A temperature sensor 38 is associated with each of the base and extension screed portions 18, 30, and the switching device 42 is adapted to controllably connect selected ones of the base and extension screed temperature sensors 38 to the heating element controller 26. In a preferred embodiment, the heating elements 22, 34 are resistive electrical heating elements, but may also be fuel fired burner elements.

In the case of a segmented screed 10 as previously discussed, the base screed portion 18 of interest is the outermost portion of the segmented base screed. In this configuration, the innermost portions of the base screed may also include respective heating elements 24 and temperature sensors 40 connected to the heating element controller 26 in a conventional feedback arrangement in which respective heating elements 24 respond directly to respective associated temperature sensors 40. Where this configuration is used, any portions of the base screed that employ such direct static temperature control in which the associated temperature sensors 40 are not connectable to the switching device 42 are likewise not subject to control in accordance with the present invention.

The switching device 42 includes a number of electrical connectors 46, 50 corresponding at least to the maximum desired number of connectable extension screed portions 30. Each of the extension screed portions 30 may also include a respective electrical connector 48, 52 suitable for plugging in to or mating with the switching device electrical connectors 46, 50. Mating the extension screed portion electrical connectors 48, 52 with selected ones of the switching device electrical connectors 46, 50 determines which of the temperature sensors 38 are actually connected to the heating element controller 26.

A predetermined one of the switching device electrical connectors 46 is connected to the relay 54, and each of the extension screed portion electrical connectors 48, 52 includes a mechanism 58 sufficient to actuate the relay 54 in response to connecting an extension screed portion electrical connector 48, 52 to the predetermined switching device electrical connector 46. In particular, the relay activation mechanism 58 may be an internal connection within the extension screed portion electrical connectors 48, 52 that, when connected to the predetermined one of the switching device electrical connectors 46 that is associated with the relay 54, closes a circuit to provide electrical power to switch the relay 54. As a consequence, plugging an extension screed portion electrical connector 48, 52 into the predetermined one of the switching device electrical connectors 46 causes the relay 54 to select an appropriate temperature sensor 38 that will be connected to the heating element controller 26.

In another embodiment, each of the temperature sensors 38 may be connected to the heating element controller 26 in response to plugging the extension screed portion electrical connectors 48, 52 into the switching device electrical connectors 46, 50. In this embodiment, none of the switching device electrical connectors 46, 50 are associated with a relay. Instead, the temperature sensor 38 associated with each extension screed portion 30 that is plugged in is connected to the heating element controller 26. All of the temperature signals received by the heating element controller 26 from the extension screed portions 30 and the base screed portion 18 are averaged by the heating element controller 26, and the heating elements 34 are controlled in response to this determined average value. However, this simplified embodiment does not optimize the amount of heat provided to each of the base and extension screed portions 18, 30.

INDUSTRIAL APPLICABILITY

In a typical paving operation, a screed assembly 10 associated with a paving machine 14 must be properly configured prior to beginning paving activity. Where present, the left-hand and right-hand segments of the base screed portions 18 are extended in opposite directions from the machine 14. An appropriate number of extension screed portions 30 are then mechanically attached one to another and to the ends of the base screed portions 18 to provide a desired working width of the overall screed 10. A typical configuration might include two extension screed portions 30 connected sequentially to each of the left and right-hand sides of the screed 10. However, some applications will not require any extension screed portions 30 while others might require only one or more than two.

With the extension screed portions 30 mechanically attached to the base screed portions 18, an electrical connector 48, 52 on each of the extension screed portions 30 is selectively mated with an electrical connector 46, 50 associated with the switching device 42. As mentioned above, each of the right-hand and left-hand halves of the screed 10 is configured identically, and a switching device 42 may be found on each screed half or a single switching device 42 may be configured to accept connections from both screed halves. In either case, the switching devices 42 will connect to the heating element controller 26.

The particular one of the switching device electrical connectors 46, 50 into which an extension screed portion electrical connector 48, 52 is inserted will determine which of the temperature sensors 38 will control the electrical current supplied from the heating element controller 26 to particular ones of the heating elements 22, 34. For example, in the case where no extension screed portions 30 are used, the relay 54 in the switching device 42 will be in the normally closed position. Therefore, the base temperature sensor 38 will be connected through the relay 54 to the heating element controller 26.

In the case where one extension screed portion 30 is to be used in association with a base screed portion 18, the operator may choose to connect the extension screed portion 30 to any of the switching device electrical connectors 46, 50. In the event that the extension screed portion 30 is connected to the switching device electrical connector 50 that is not connected to the relay 54, the relay activation mechanism 58 will not actuate the relay 54 and the base temperature sensor 38 will control the temperature of both the respective base screed portion 18 and the connected extension screed portion 30. This is because the extension screed portion temperature sensor 38 remains isolated from the heating element controller 26.

However, if the extension screed portion 30 is instead connected to the switching device electrical connector 46 connected to the relay 54, the relay activation mechanism 58 will cause the relay 54 to switch, resulting in the extension screed temperature sensor 38 being connected to the heating element controller 26 and the base temperature sensor 38 being disconnected from the controller 26. In this case, feedback from the extension screed portion temperature sensor 38 will control the amount of heat delivered to both the base and extension screed portions 18, 30. The operator will decide which of these configurations to use depending on whether the extension screed portion 30 is operating too hot or too cold, determined according to the mat finish that the operator observes as paving proceeds.

In like manner, if two or more extension screed portions 30 are to be used on a side of the screed 10 in a given instance, the operator is free to select whether the inner or outer ones of the extension screed portions 30 are to control the amount of heat delivered to each of the base and extension screed portions 18, 30. Again, selecting which of the switching device electrical connectors 46, 50 into which to plug a selected one of the inner and outer extension screed portions 30 will determine whether the inner or the outer extension screed temperature sensor 38 is connected to the heating element controller 26 and, consequently, will determine which of the inner and outer-most extension screed portions 30 controls the amount of heat to be delivered to the base and extension screed portions 18, 30.

In this way, by merely selecting appropriate mating connections between the extension screed electrical connectors 48, 52 and the switching device electrical connectors 46, 50, the paving machine operator can exercise control over the amount of heat delivered to the various screed portions 18, 30. Consequently, the quality of the pavement mat produced may be enhanced.

Although the invention has been described with reference to a preferred embodiment, it is clear in light of the overall disclosure that one skilled in the relevant arts may readily recognize or conceive modifications, variations, and alternative constructions not specifically addressed in detail above. For example, one could readily replace the specially configured connectors described above with a suitable mechanical switch, such as a toggle switch, to accomplish the selection of temperature sensors to be connected to the heating element controller. Likewise, the selection could be controlled through the use of electronic logic and control circuitry without using mechanical switching devices. These and other adaptations are intended to be covered by the appended claims.

Other aspects, objects, and advantages of this invention may also be obtained from a study of the drawings, the disclosure, and the appended claims.

What is claimed is:

1. A screed for a paving machine, said screed having at least one base screed portion, said base screed portion having an associated heating element connected to a heating element controller, comprising:

at least one extension screed portion connectable to said base screed portion, said extension screed portion having a respective heating element connectable to said heating element controller;

a temperature sensor associated with each of said base and extension screed portions; and a switching device adapted to controllably connect selected ones of said base and extension screed temperature sensors to said heating element controller to determine which of the temperature sensors are connected to the heating element controller.

2. A screed for a paving machine, as set forth in claim 1, wherein said switching device includes a number of electrical connectors corresponding at least to the maximum desired number of connectable extension screed portions, and each of said extension screed portions includes a respective electrical connector, and wherein the mating of said extension screed portion electrical connectors with selected ones of said switching device electrical connectors determines which of said temperature sensors are connected to said heating element controller.

3. A screed for a paving machine, as set forth in claim 2, wherein at least a predetermined one of said switching device electrical connectors is connected to a relay and each of said extension screed portion electrical connectors includes a mechanism sufficient to actuate said relay in response to connecting an extension screed portion electrical connector to said at least one predetermined switching device electrical connector.

4. A system for controlling the temperature of the screed plates of a paving machine screed, said screed including a heating element controller and having at least one base screed portion and at least one extension screed portion connectable to said base screed portion, each of said base and extension screed portions having a respective heating element connectable to a heating element controller and having a respective temperature sensor positioned to be responsive to the temperature of said respective screed plate, comprising:

means for connecting said at least one extension screed portion to said temperature controller; and means for controlling the temperature of said base and extension screed plates in response to said connecting means.

5. A system, as set forth in claim 4, wherein said connecting means includes a number of electrical connectors corresponding at least to the maximum desired number of connectable extension screed portions, and wherein each of said extension screed portions includes a respective electrical connector adapted to mate with any of said switching device electrical connectors.

6. A system, as set forth in claim 5, wherein said controlling means includes a relay connected to at least a predetermined one of said switching device electrical connectors, and wherein each of said extension screed portion electrical connectors includes a mechanism sufficient to actuate said relay in response to connecting an extension screed portion electrical connector to said at least one predetermined switching device electrical connector.

7. A method for selectively controlling heating elements associated with a screed for a paving machine, said screed including at least one base screed portion having a heating element connected to a heating element controller and one or more extension screed portions connectable to said base screed portion, each of said extension screed portions having a respective heating element connectable to said heating element controller, a temperature sensor associated with each of said base and extension screed portions, and a switching device adapted to controllably connect selected ones of said temperature sensors to said heating element controller, said switching device including a number of electrical connectors corresponding to at least to the maximum desired number of connectable extension screed portions, comprising the steps of:

connecting a desired number of said extension screed portions to selected respective ones of said switching device electrical connectors;

connecting at least a predetermined one of said temperature sensors to said heating element controller in response to the selected mating of said extension screed portions to said electrical connectors; and responsive to connecting at least a predetermined one of the temperature sensors, determining which of the temperature sensors are connected to the heating element controller.

8. A method, as set forth in claim 7, including the step of actuating said extension screed portion heating elements in response to temperature signals received from said predetermined one of said temperature sensors.

9. A method, as set forth in claim 8, wherein the step of actuating said extension screed portion heating elements includes the step of delivering electrical power from said heating element controller to said extension screed portion heating elements.

10. A method for selectively controlling heating elements associated with a screed for a paving machine, said screed including at least one base screed portion having a heating element connected to a heating element controller and one or more extension screed portions connectable to said base screed portion, each of said extension screed portions having a respective heating element connectable to said heating element controller, a temperature sensor associated with each of said base and extension screed portions, and a switching device adapted to controllably connect selected ones of said temperature sensors to said heating element controller, said switching device including a number of electrical connectors corresponding at least to the maximum desired number of connectable extension screed portions, the method comprising:

connecting a desired number of the extension screed portions to selected respective ones of the switching device electrical connectors;

connecting at least a predetermined one of the temperature sensors to the heating element controller in response to the selected connection of the extension screed portions to the electrical connectors; and actuating the base and extension screed portion heating elements in response to temperature signals received from the predetermined one of the temperature sensors.

11. A method as set forth in claim 10, wherein actuating the base and extension screed portion heating elements includes delivering electrical power from the heating element controller to the base and extension screed portion heating elements.

* * * * *

UNITED STATES PATENT AND TRADEMARK OFFICE

CERTIFICATE OF CORRECTION

PATENT NO. : 7,217,062 B2
APPLICATION NO. : 11/063259
DATED : May 15, 2007
INVENTOR(S) : Pisano et al.

It is certified that error appears in the above-identified patent and that said Letters Patent is hereby corrected as shown below:

In Column 1, Line 34, delete “modem” and insert -- modern --, therefor.

Signed and Sealed this

First Day of July, 2008

JON W. DUDAS
*Director of the United States Patent and Trademark Office*